US008548655B2

(12) United States Patent
Kanner

(10) Patent No.: US 8,548,655 B2
(45) Date of Patent: Oct. 1, 2013

(54) METHOD AND SYSTEM FOR GRADE CROSSING PROTECTION

(75) Inventor: Abe Kanner, Mississauga (CA)
(73) Assignee: Thales Canada Inc., Ontario (CA)

( * ) Notice: Subject to any disclaimer, the term of this patent is extended or adjusted under 35 U.S.C. 154(b) by 1220 days.
(21) Appl. No.: 11/861,180
(22) Filed: Sep. 25, 2007
(65) Prior Publication Data
US 2008/0103648 A1 May 1, 2008

Related U.S. Application Data
(60) Provisional application No. 60/863,045, filed on Oct. 26, 2006.

(51) Int. Cl.
*G05D 1/00* (2006.01)
*G01S 13/00* (2006.01)
*B61C 3/00* (2006.01)
(52) U.S. Cl.
USPC ..... 701/19; 342/23; 105/61
(58) Field of Classification Search
USPC ..... 701/19, 20, 2, 23, 24, 28; 246/3–15, 246/24, 27, 28 R, 38, 34 A, 44, 55, 74, 91, 246/105, 113, 126, 133, 136, 160, 182 R, 246/182 A, 219, 167 R; 342/357.23; 715/761; 37/198, 104
See application file for complete search history.

(56) References Cited

U.S. PATENT DOCUMENTS 5,098,044 A * 3/1992 Petit et al. ..... 246/187 A
5,729,213 A * 3/1998 Ferrari et al. ..... 340/901
5,983,161 A * 11/1999 Lemelson et al. ..... 701/301

* cited by examiner

*Primary Examiner* — Muhammad Shafi
(74) *Attorney, Agent, or Firm* — Lowe Hauptman & Ham, LLP

(57) ABSTRACT

Apparatus and methods for a grade crossing protection system include at least one camera providing surveillance of a grade crossing, the at least one camera coupled to a transmitter configured to transmit a signal that includes imagery of the grade crossing to a transceiver onboard a train. A display unit onboard the train is provided to allow the train operator to view the grade crossing. A control unit in communication with the transceiver is configured to monitor the received signal and, based upon a determined location of the train relative to the train crossing, issue a command to the train's brake system to reduce the speed of the train, or stop the train, before the train reaches the grade crossing.

12 Claims, 3 Drawing Sheets

METHOD AND SYSTEM FOR GRADE CROSSING PROTECTION

RELATED APPLICATIONS

The present application is based on, and claims priority from, U.S. Provisional Application No. 60/863,045, filed Oct. 26, 2006, the disclosure of which is hereby incorporated by reference herein in its entirety.

FIELD OF THE INVENTION

The present invention relates generally to railroad grade crossing systems, and more specifically to a method and apparatus for providing a train operator with imagery of the grade crossing and automatically reducing the speed of the train as it approaches the grade crossing.

BACKGROUND OF THE INVENTION

Grade crossings are locations on a rail line where vehicular traffic crosses the rail line. It is at these grade crossings where there exists a potential of an accident between an approaching train and an obstacle, e.g., a car that became trapped on the grade crossing.

Grade crossings exist in both urban and rural areas, and in some instances are equipped with devices intended to prevent vehicular traffic from occupying the grade crossing just prior to the arrival of approaching train traffic.

Grade crossing protection (GCP) devices are normally fixed installations at crossings with both visual and/or audible signals and physical barriers. Activation of these devices generates signals that warn oncoming vehicular traffic of the impending arrival of a train while barriers block the road to prevent vehicular traffic from occupying the crossing when the train approaches. GCP devices may be connected to transmitting devices along the track so that the train engineer is notified of their activation placing the crossing in a "safe" state thereby allowing the train to proceed into the grade crossing.

Current grade crossing protection systems operate on the principle that if the GCP device is operational, the grade crossing area, protected by the devices, is clear of obstacles. However, it is possible, even with a fully operational GCP device, for a vehicle, or other obstacle, either by accident or by design, to be within the grade crossing as the train approaches, leaving the engineer insufficient time to stop the train, even after detecting the obstruction.

SUMMARY OF THE INVENTION

One aspect of a system for increasing the safety of railroad grade crossings includes at least one camera providing surveillance of a grade crossing, the at least one camera coupled to a transmitter configured to transmit grade crossing imagery to a transceiver onboard a train viewable by the train operator. A control unit in communication with the transceiver is configured to monitor the received signal and, based upon a determined location of the train relative to the grade crossing, issue a command to the train's brake system to reduce the speed of the train, or stop the train, before the train reaches the grade crossing.

A further aspect of the present invention includes an onboard method to implement the functions described above.

Yet another aspect includes a control unit mountable onboard a train for implementing the method described above.

BRIEF DESCRIPTION OF THE DRAWINGS

The present apparatus and methods are illustrated by way of example, and not by limitation, in the figures of the accompanying drawings, wherein elements having the same reference numeral designations represent like elements throughout and wherein.

DETAILED DESCRIPTION OF THE EXEMPLARY EMBODIMENTS

Figure 1:
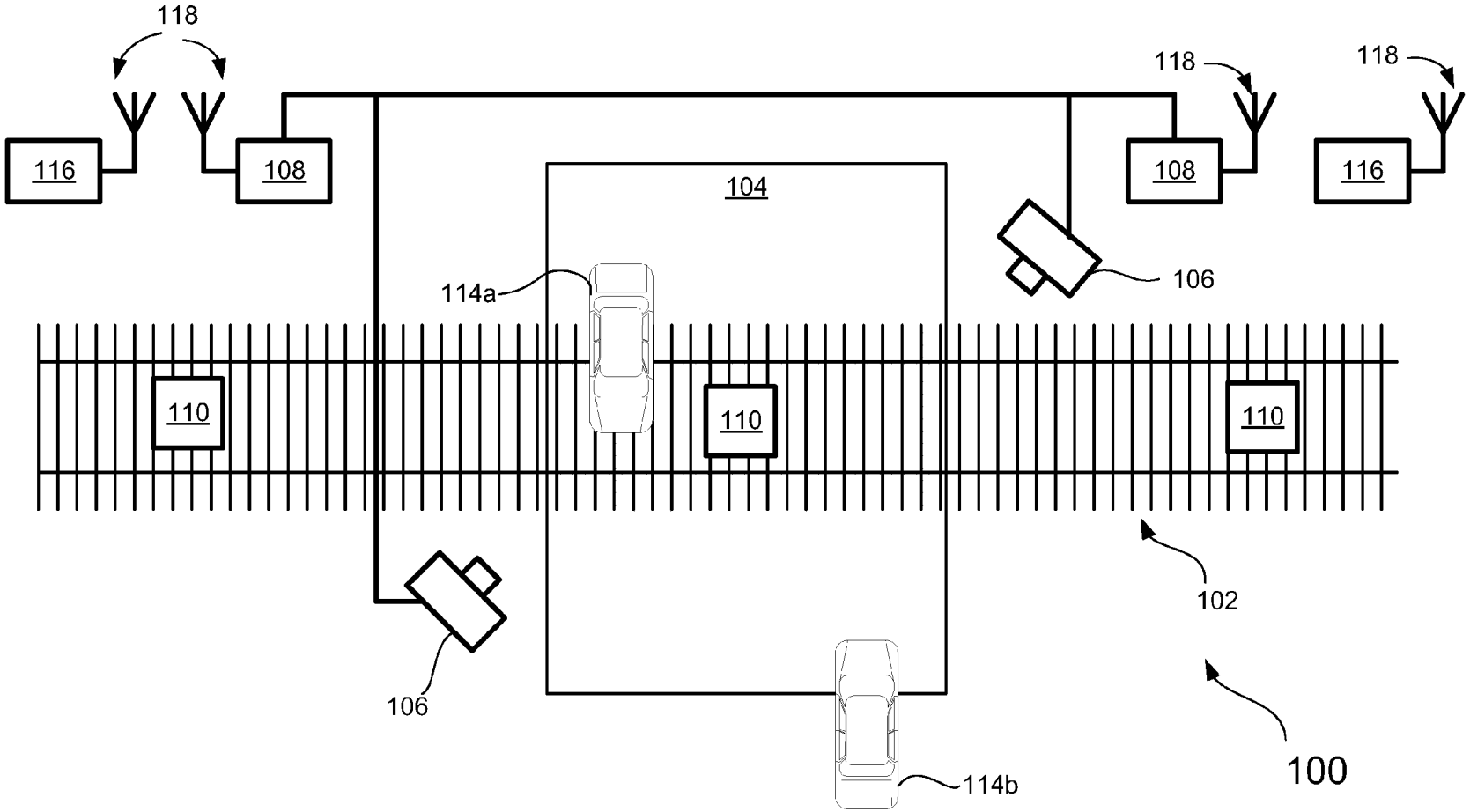
FIG. 1 is an environmental drawing of a grade crossing monitoring system, according to the present invention.

FIG. 1 is an illustration of a grade crossing monitoring system 100 configured to provide visual monitoring of a surveillance area of a railroad grade crossing 104.

The grade crossing monitoring system 100 includes at least one closed circuit TV camera 106 coupled to at least one radio transceiver 108 and antenna 118. As illustrated in FIG. 1, two cameras 106 are mounted so as to provide a view of crossing 104 that allows for detection of any obstruction of railroad track 102 within a surveillance area of crossing 104. In at least one embodiment, cameras 106 are conventional optical cameras, color or black and white. In other embodiments, one or more cameras 106 include an infrared camera to provide further detection capability. In still other embodiments the grade crossing 104 is equipped with lights to allow detection of obstructions in low light conditions.

Radio transceiver 108 transmits the image of the surveillance area 104 to trains approaching the crossing via a network of repeater radio units 116 at a rate of at least 5 frames a second on a continuous basis. In at least one embodiment, images are digitally transmitted to trains approaching the crossing 104 in both directions and transceivers 108 are configured to communicate with multiple trains simultaneously by broadcasting the images on all transceivers 108. In other embodiments, a single transceiver 108 capable of transmitting on multiple channels may be deployed.

The radio antennas 118 are arranged so that the fastest approaching train with the worst braking characteristics will be able to receive an image of crossing 104 well in advance of the crossing to allow the train to stop should an obstruction, i.e., vehicles 114, be observed by the onboard train operator viewing the image on a display monitor.

In at least one embodiment, radios 108 and 116 are digital radios operating in the 2.4 GHz. ISM band. The benefits of the ISM band include: resistance to radio frequency interference, multiple systems can share the band, two-way communication allows for acknowledged data transfers with retransmits as needed, and automatic load balancing.

Figure 2:
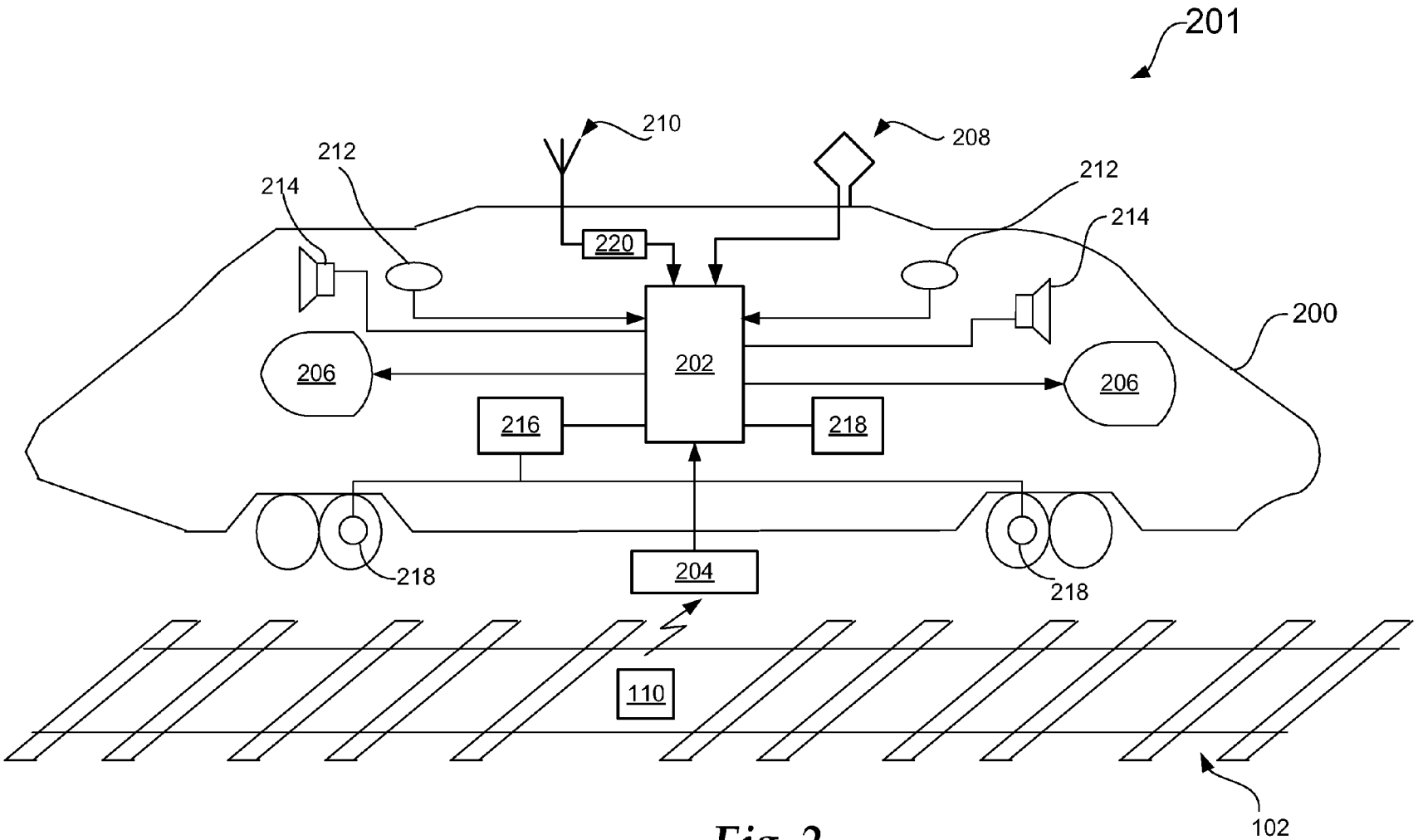
FIG. 2 illustrates a block diagram of an onboard portion of a grade crossing protection system, according to the present invention.

FIG. 2 illustrates a train 200 equipped with an onboard grade crossing protection system (OGCPS) 201 configured to receive input from the radio transceivers 108 and 116, allowing the train operator to monitor the grade crossing while the train is still far enough away to stop the train. At least one display unit 206 provides the train operator with a visual image of the approaching grade crossing 104.

Because the distance required to stop the train depends at least upon the speed of the train, OGCPS is further configured to reduce the speed of the train to a safe speed while approaching the grade crossing 104, while the crossing 104 is being continuously monitored by the train operator.

In some embodiments, a train engine 200 is configured to be operated in either direction. Accordingly, FIG. 2 illustrates wherein user interface components, e.g., display 206, alarm 214, and override switch 212, are replicated in the engineer compartments on both ends of the engine 200.

An onboard control unit 202 controls all functions of the OGCPS that receives images from radio transceivers 108 and 116 via ISM transceiver 220 and antenna 210.

In some aspects, control unit 202 comprises at least one processor and a memory, hardware, software and/or firmware configured to execute one or more stored application program stored in the memory. In still other embodiments, control unit 202 comprises an application-specific integrated circuit (ASIC), or other chipset, processor, microprocessor, logic circuit, or other data processing device operable to perform one or more processing functions of the grade crossing protection system.

Control unit memory includes any type of non-volatile memory, including read-only memory (ROM), random-access memory (RAM), EPROM, EEPROM, flash memory cells, secondary or tertiary storage devices, such as magnetic media, optical media, tape, or soft or hard disk, whether resident in control unit 202 or remote therefrom. Application logic residing in memory includes the program instructions operated upon by the processor to control all functions of OGCPS 201.

Control unit 202 is configured to ensure that the train approaches each grade crossing 104 at a speed at which the train operator can, if necessary, stop the train prior to the crossing. A safe speed for each crossing 104 may be different for each grade crossing and, in some embodiments, is determined by a number of factors, including but not limited to, any curves in the approach to the crossing, weather and lighting conditions, and braking characteristics of each specific train. This information is stored in control unit memory and may be entered into memory locally by an authorized user, loaded via a medium such as a disk, downloaded via a network connection, or received via the radio network over transceiver 220. Similarly, the location of each grade crossing 104 is programmed into control unit 202.

In some embodiments, train 200 is equipped with global positioning system receiver 208 that provides continuous real-time positioning information to control unit 202 and, as explained below, allows control unit 202 to determine the position of the train 200 relative to the position of crossing 104. Based upon the distance to the crossing, and the speed of the train, control unit 202 controls the speed of the train during the approach to the crossing 104.

In still other embodiments, train position is determined by positioning transponders 110 strategically placed on the train tracks 102. For example, a signal, e.g., an ISM band signal transmitted by positioning transponder 110, is detected by receiver 204 when the train 200 passes over positioning transponder 110. The signal received by receiver 204 allows control unit 202 to determine the absolute position of the train on the train line. For example, positioning transponder 110 may transmit a location code that correlates to distance information stored in control unit 202. Furthermore, when the train is in between positioning transponders 110, control unit 202 is operable to use dead reckoning to determine the train's position based upon the last known position train 200 and the speed of the train, which in some embodiments is received from train interface unit 216.

Control unit 202 is integrated electrically, and/or mechanically, with the train's operation systems via train interface 216. Specifically, interface 216 is at least coupled to the train's braking system 218 and allows control unit 202 to slow down and/or stop the train based upon application logic resident in control unit 202.

In some embodiments, braking system 218, with which control unit 202 interfaces with via train interface 216, includes both the train's service and emergency brakes. The initial activation of braking results in utilization of the service brakes which, in some embodiments, is automatically revoked by control unit 202 should application of the service brakes be sufficient. However, should control unit 202 determine that the train's braking performance is insufficient, the train's emergency brakes are activated to bring the train to a stop.

OGCPS 201 further includes an alarm 214 activated by control unit 202 and is configured to alert the train operator of an approaching grade crossing 104. In some embodiments, alarm 214 comprises an audible alert signal in addition to a visual indicator.

In addition, under special circumstances, such as when the grade crossing is under observation by the train operator, the train operator may activate override switch 212 to override the automatic brake control applied by the OGCPS 201. Once overridden, the train operator is free to increase the speed of train 200 beyond the predetermined safe speed.

Logging device 218 is connected to control unit 202 and is configurable to record all data received from radio 220, GPS receiver 208, positioning transponder receiver 204, interface unit 216, override switch 212, as well as to record all actions initiated by control unit 202.

Figure 3:
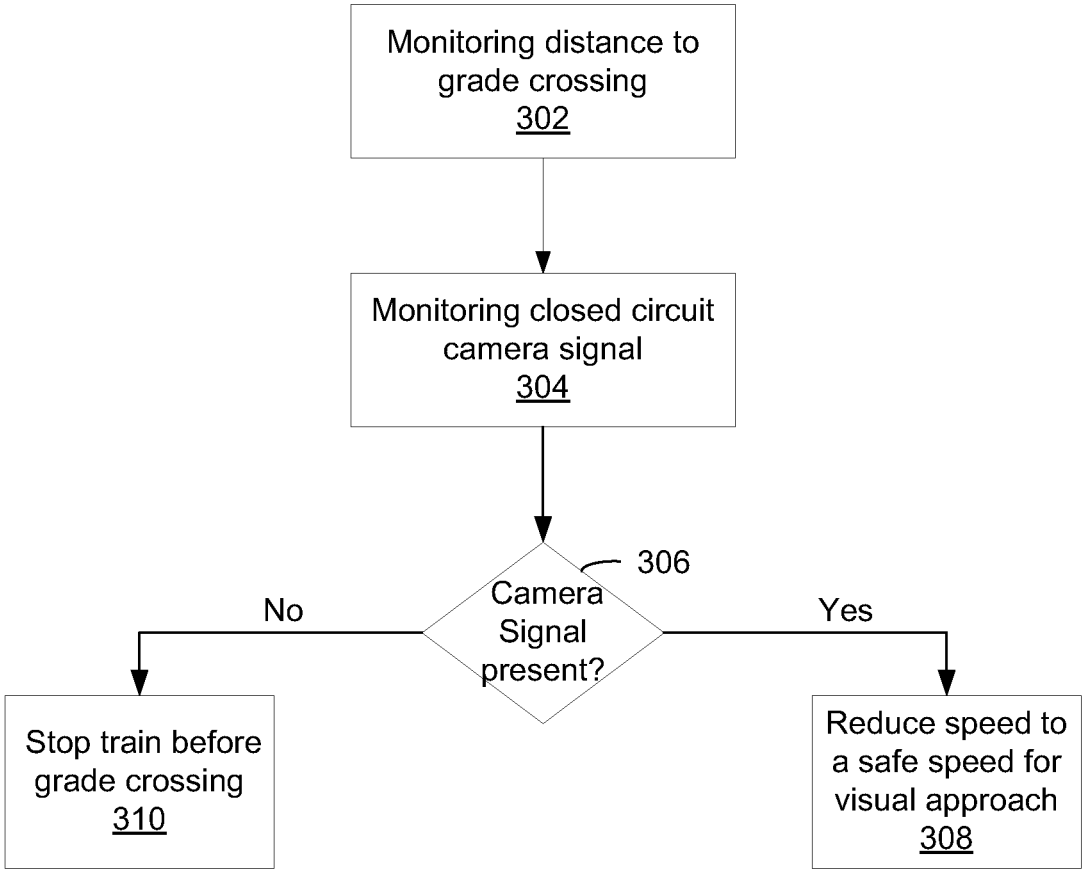
FIG. 3 illustrates one embodiment of a grade crossing protection method, according to the present invention.

FIG. 3 illustrates an exemplary flowchart of a method implemented by control unit 202 to prevent accidents from occurring at railroad grade crossings. Functional block 302 involves continuous monitoring of the distance from train 200 to grade crossing 104 using at least one of GPS receiver 202 and positioning transponder receiver 204 in conjunction with a known location of grade crossing 104. Using this information, control unit 202 is operable to determine when and where to start reducing the speed of the train or, in the event of a loss of radio signal from the grade crossing 104, stop the train prior to reaching the grade crossing.

Functional block 304 monitors the radio signal received from the grade crossing. In some embodiments, monitoring of the signal involves a simple determination that the radio link is up and data is being received. One of the benefits of the ISM band is the ability of the radios to acknowledge data transfers and provide fault management. In other embodiments, control unit 202 performs additional signal processing to determine that a video signal is actually being received.

In still other embodiments, control unit 202 is operable to monitor the operation of display device 206 to further ensure that the image of crossing 104 is visible to the train operator.

Based upon the results of block 304, a determination is made whether a camera signal is present. If present, the control unit 202 issues a command, via train interface unit 216, to brake system 218 to reduce the speed of the train to a speed that would allow the train operator to stop the train should the operator observe a potentially unsafe situation at the crossing.

However, in the absence of a received radio signal from the grade crossing, control unit 202 initiates a command to stop train 200 prior to crossing 104.

Alarm 214 is configurable to alert the train operator to several operational states, including, but not limited to, the train arriving at a predetermined distance from the crossing, failure to receive the transmitted grade crossing signal, and activation of override switch 212.

The grade crossing protection system disclosed above provides a train operator with a visual image of a grade crossing well in advance of arriving at the crossing and automatically initiates braking at a safe distance from the crossing. A further safety feature includes automatically stopping the train before the crossing should the image transited from the grade crossing be lost.

While the foregoing disclosure shows illustrative aspects and/or aspects, it should be noted that various changes and modifications could be made herein without departing from the scope of the described aspects and/or aspects as defined by the appended claims. Furthermore, although elements of the described aspects s described or claimed in the singular, the plural is contemplated unless limitation to the singular is explicitly stated. Additionally, all or a portion of any aspect and/or aspects may be utilized with all or a portion of any other aspect and/or aspect, unless stated otherwise.

What is claimed is:

1. A method for automatically braking a train approaching a grade crossing comprising the steps of:

receiving, by an onboard control unit, a transmission comprising imagery of a surveillance area at a grade crossing;

displaying the received imagery on a device viewable by a train operator;

determining a position of the train relative to the grade crossing;

automatically reducing, by the onboard control unit, train speed to a predetermined speed at a predetermined distance from the grade crossing; receiving an override command from an operator of the train; and overriding the automatic reduction in speed of the train based upon a status of the received transmission.

2. The method of claim 1, further comprising:

determining a position of the train based upon a Global Positioning Satellite signal.

3. The method of claim 1, further comprising:

determining a position of the train based upon a location signal received from a positioning transponder disposed along the train track; and comparing the position of the train to a stored location of the grade crossing.

4. The method of claim 1, further comprising:

determining a received status of the transmission from grade crossing; and stopping the train prior to the grade crossing based upon the determined status of the received signal.

5. The method of claim 1, wherein overriding the automatic reduction in speed comprises maintaining the speed of the train.

6. The method of claim 1, wherein overriding the automatic reduction in speed comprises increasing the speed of the train.

7. The method of claim 1, further comprising stopping the train prior to the grade crossing based upon determining a lack of receipt of a subsequent transmission comprising imagery.

8. The method of claim 1, wherein the receiving comprises receiving a near-real time visual image of the surveillance area.

9. The method of claim 1, wherein the receiving comprises receiving a continuous sequence of images of the surveillance area.

10. A method of controlling a train approaching a grade crossing comprising:

receiving, by an onboard control unit, imagery of a surveillance area at a grade crossing;

displaying received imagery of the surveillance area at the grade crossing on a device viewable by a train operator;

monitoring the distance from the train to the grade crossing;

automatically reducing, by the onboard control unit, train speed to a predetermined speed at a predetermined distance from the grade crossing;

increasing or maintaining the train speed responsive to receipt of an override command from an operator of the train if imagery is displayed to the train operator;

stopping the train if imagery is not displayed to the train operator and an override command is not received from the train operator; receiving an override command from an operator of the train; and overriding the automatic reduction in speed of the train based upon a status of the received transmission.

11. The method of claim 10, wherein the receiving comprises receiving a near-real time visual image of the surveillance area.

12. The method of claim 10, wherein the receiving comprises receiving a continuous sequence of images of the surveillance area.

* * * * *